US005119730A

United States Patent [19]

Garnett et al.

[11] Patent Number: 5,119,730

[45] Date of Patent: Jun. 9, 1992

[54] COMPOSITE SHEET STRINGER ORDNANCE SECTION

[75] Inventors: Charles R. Garnett, Dahlgren; William M. Henderson, Ninde; Leonard T. Wilson, Fredericksburg, all of Va.

[73] Assignee: The United States of America as represented by the Secretary of the Navy, Washington, D.C.

[21] Appl. No.: 740,523

[22] Filed: Aug. 5, 1991

[51] Int. Cl.[5] ..... F42B 12/32

[52] U.S. Cl. ..... 102/496; 102/473

[58] Field of Search ..... 102/293, 374, 389, 473, 102/474, 478, 489, 491–497, 505, 506

[56] References Cited

U.S. PATENT DOCUMENTS

| | | | |
|---|---|---|---|
| H238 | 3/1987 | Adams | 102/493 |
| 47,544 | 5/1865 | Hotchkiss | 102/478 |
| 2,872,865 | 2/1959 | Skaar | 102/473 |
| 2,976,806 | 3/1961 | Risk et al. | 102/293 |
| 3,799,054 | 3/1974 | LaRocca | 102/64 |
| 3,815,504 | 6/1974 | Tieben | 102/67 |
| 3,977,327 | 8/1976 | Brumfield et al. | 102/67 |
| 4,216,720 | 8/1980 | Kempton | 102/67 |
| 4,305,333 | 12/1981 | Altenau et al. | 102/306 |
| 4,406,227 | 9/1983 | Beeker et al. | 102/505 |
| 4,592,283 | 6/1986 | Hellner et al. | 102/493 |
| 4,644,867 | 2/1987 | Hellner et al. | 102/495 |
| 4,781,117 | 11/1988 | Garnett et al. | 102/493 |

*Primary Examiner*—Harold J. Tudor

*Attorney, Agent, or Firm*—John D. Lewis; Kenneth F. Walden

[57] ABSTRACT

The conventional monocoque missile ordnance section is replaced by a composite sheet stringer design. The composite sheet stringer design consists of a full-length, filamentary composite outer shell attached to stringers. Bending and axial loads are carried by the stringers while the outer shell will resist shear loads. The forward part of the ordnance section is devoted to the warhead. Here, fragment material would be sandwiched between the stringers, the outer shell, and possibly a filamentary composite inner shell. Fragment options include discrete fragments, plates, or rods. The aft part of the ordnance section would be available for fuzing assemblies. The composite ordnance section is connected to the rest of the missile through end joints rigidly attached to the outer composite shell and stringers.

4 Claims, 2 Drawing Sheets

COMPOSITE SHEET STRINGER ORDNANCE SECTION

The invention described herein may be manufactured and used by or for the Government of the United States of America for governmental purposes without the payment of any royalties thereon or therefor.

BACKGROUND OF THE INVENTION

The present invention relates generally to improvements in ordnance and more particularly to the construction of warhead cases and missile mainframe members.

In the prior art, most missile fragmentation warheads either use a solid steel case filled with explosive (which is the conventional design) or consist of explosive surrounded by a thin shell with "discrete" fragments glued to the shell, which is generally called the discrete fragment design. In either case the warhead is then mounted into the ordnance section where structural loads are carried by a surrounding shroud.

An example of the conventional steel case design is LaRocca, U.S. Pat. No. 3,799,054 filed Mar. 26, 1974. This reference teaches a warhead for controlling the fragmentation of explosive devices having a cylindrical metallic fragmentation casing, wrapped with metallic strips of heavy density to cause fragments to form. This type of construction employs heavy construction materials which, by necessity, must be massive in areas that optimum airframe design would dictate a lighter or different design. This conventional warhead highlights the design tension between fragmentation and structural integrity. Generally a missile airframe demands light, strong materials, and warhead fragments need to be heavy, close tolerance objects. Methods for achieving uniform fragmentation are generally not consistent with good airframe design.

The second standard type of ordnance case construction, the discrete fragment design is represented by Brumfield et al., U.S. Pat. No. 3,977,327 filed Aug. 31, 1976. The Brumfield et al. reference is typical of many fragmentation schemes which precut fragments and then must sandwich them between steel or aluminum cylinders to form the case. The required airframe structure is then parasitic weight from a warhead design perspective.

In a like manner, both the discrete fragment and the conventional design share a common flaw from the overall system perspective. In both designs the warhead is usually carried as parasitic weight within a surrounding missile shroud. There are two drawbacks to this. First, the warhead is forced to "blow" through the shroud. Having to do this degrades fragment breakup as well as fragment velocity. Second, to minimize fragment degradation the missile shroud is made as thin and light as possible in the blow through area thereby reducing the shroud's structural integrity.

This parasitic weight issue can be alleviated to some degree by utilizing an integral warhead with a removable explosive assembly. However, this option suffers from an inability to customize fragmentation and from a weight penalty caused by using a steel shroud.

The problem of parasitic weight is attenuated by Applicants' invention entitled "Filamentary Composite Dual Wall Discrete Fragment Warhead," Ser. No. 07/740,522 filed even date with this application. While considered nonessential to the claims of this application, the Dual Wall Warhead might be the warhead of choice in smaller missiles. Likewise, there are many design choice fragmentation techniques available to the designing technician. One such device suitable for constructing a fragmentation panel which might be used with the present ordnance section is shown in Applicants' copending application Ser. No. 07/740,524, entitled "Fragmenting Notched Rod for Warheads" filed even date with this application. The teachings of this application, while also considered nonessential to the claims appended hereto, provide a general description of one of many possible fragmentation panels. Another possible fragmentation panel might be constructed of composite fragmenting rods, taught in Applicants' copending application entitled "Composite Fragmenting Rods for Warheads," Ser. No. 07/740,528, also filed even date with this application. The teachings of this application are likewise nonessential to the claims appended hereto.

Another recent concern in the warhead arts is the development of warheads that are safe to carry on our nation's ships and aircraft..These concerns are reflected in the new insensitive munitions requirements which became effective for all naval munitions in 1987. One of these requirements is that a warhead survive a fire or high heat environment without exploding. The steel or metallic case warheads do not allow the venting necessary so that the explosive mix burns rather than explodes. Elaborate cook-off plugs and other schemes to allow venting further degrade the case integrity and further reduce strength.

The disadvantages of the conventional design and the discrete fragment design are overcome by the present invention which provides a lightweight, easily manufactured missile mainframe member which will also integrate the warhead and any associated electronics.

SUMMARY OF THE INVENTION

The present invention consists of a full-length, thin outer shell attached to stringers. As in classical sheet stringer design, the stringers will carry the axial and bending loads while the outer shell will resist shear loads. The ordnance section is connected to the rest of the missile through end joints rigidly attached to the shell and stringers. In one embodiment, the forward part of the ordnance section is devoted to the warhead. Here, fragment material would be placed between the stringers surrounding the explosive. Options include discrete fragments, notched plates, or fragmenting rods. The inner shell holds the explosive. If necessary, a removable explosive assembly can be configured for this design. In one embodiment the aft part of the section contains the electronics assemblies. In this section, the electronic components can be attached to hard points located on the stringers.

All shells may be constructed using filamentary laminated composite materials. Forward and aft covers for the warhead may be made using either a laminated composite or an engineering plastic. Stringers and end joints for the ordnance section would be constructed either using a high strength galvanically compatible material like steel, titanium, or a composite material.

OBJECTS OF THE INVENTION

An object of the present invention is, therefore, to provide an ordnance section that is structurally weight efficient.

Another object is to teach an ordnance section that integrates the warhead, missile airframe and the electronics housing into a single unit.

Yet another object of the present invention is to teach a warhead case that employs materials which enhance safety by melting in a high temperature environment, thus preventing detonation and deflagration.

It is still another object to teach an ordnance section that is easy to manufacture.

It is a further object to teach an ordnance section that may incorporate various fragmentation devices and techniques.

Other objects, advantages and novel features of the invention will become apparent from the following detailed description of the invention when considered in conjunction with the accompanying drawings which show an advantageous embodiment of the invention and wherein like numerals designate like parts in the several figures, and wherein:

DETAILED DESCRIPTION

Figure 1:
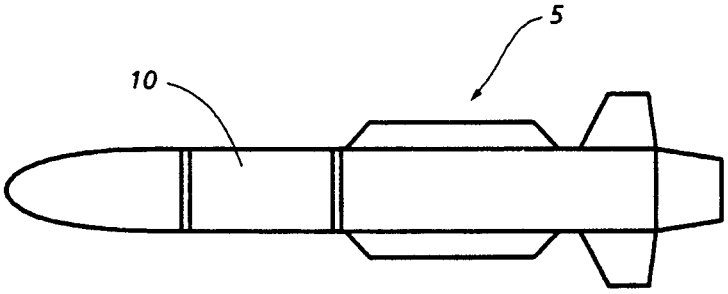
FIG. 1 is an illustration of a missile containing the composite sheet stringer ordnance section of the present invention.

Referring in detail to FIG. 1 wherein a composite sheet stringer ordnance section 10 of the present invention is illustrated in its preferred embodiment as an integral load bearing section of missile 5.

Figure 2:
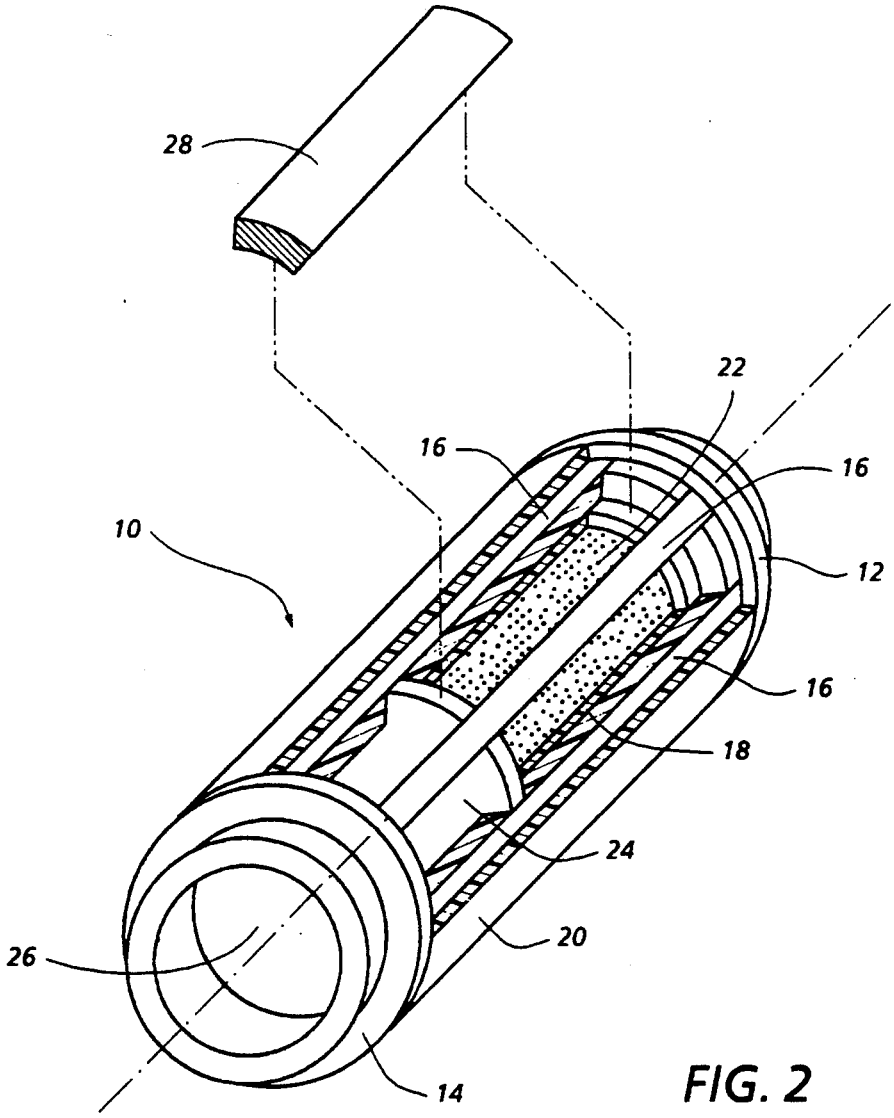
FIG. 2 is an isometric view of the composite sheet stringer ordnance section of FIG. 1.

It is a main feature of the invention that ordnance section 10 is both the warhead and part of the airframe of missile 5. FIG. 2 shows in detail how the dual function of ordnance section 10 is accomplished. Therein, a forward annular support member 12 and an aft annular support ring 14 are connected by longitudinal stringers 16 to form a cylindrical frame for attachment of an inner shell 18 and an outer shell 20 which form an ordnance section or warhead case. Forward annular support member 12 is a planar surface forming an end cap to enclose a quantity of high explosive (HE) 22. In the embodiment illustrated in FIG. 2, the HE 22 is inserted into the closed explosive cavity formed with annular support bulkhead 24. Bulkhead 24 provides both support for the warhead case and containment of HE 22. This separates the ordnance section 10 into a cavity containing HE 22 and an electronics cavity 26 for mounting warhead fuzing and associated electronics. Bulkhead 24 may be omitted in warhead embodiments where no electronic section 26 is desired by simply forming aft annular support ring 14 as a bulkhead or end cap.

It is central to this invention that inner shell 18 and outer shell 20 are constructed of composite material such as graphite epoxy. This is important because these shells, 18 and 20, carry the shear loads of the ordnance section as part of the airframe of the missile 5. These shells 18 and 20 must not only be high strength and light weight as required by aerodynamic design constraints, but must melt in a high temperature environment to meet cook-off requirements.

In the preferred embodiment, the shells 18 and 20 would be filamentary laminated composites to better carry the shear loads of the missile while increasing structural efficiency and minimizing weight. An example of these materials is graphite epoxy. In this way, the warhead 10 can meet the missile airframe demands of a strong, yet relatively light, weight structure.

The cook-off requirements are met as the filamentary laminated composites melt at low enough temperatures to prevent detonation or deflagration of the HE 22 when warhead 10 is subjected to a high temperature environment, such as a fuel fire. In a fuel fire or other high temperature situation, shells 18 and 20 would melt, thereby letting the HE 22 gases vent. This venting permits HE 22 to burn freely without detonation or deflagration.

Returning to FIG. 2, the forward 12 and aft 14 end members may be viewed. One purpose of these members is to provide rigid support for the inner 18 and outer 20 shells, and at the same time provide a means of joining the warhead 10 to the other sections of the missile airframe and as attachment points for stringers 16. Annular bulkhead 24 will also act as a support for stringer 16 in embodiments having the intermediate bulkhead 34. In large ordnance sections it may be desirable to employ more than one of bulkhead 24 to increase support.

To accomplish these tasks efficiently, the end members 12 and 14 and bulkhead(s) 24 should be constructed using galvanically compatible materials with high stiffness to weight and strength to weight ratios. Examples include titanium alloys, corrosion resistant steel alloys, and composites such as graphite epoxy.

Because the end members also are the connection points to the missile airframe, the choice of materials will be part of the overall missile design. Because stringers 16 carry the axial and bending loads of the missile they should also be constructed of various materials with high stiffness to weight and strength to weight ratios. The number of stringers and their shape and size will depend upon application. In general, the number of stringers will be minimized to optimize the fragmentation pattern of warhead 10.

Various fragmentation mechanisms may be employed with the composite sheet stringer ordnance section 10 without departing from the scope of the invention. In the preferred embodiment selected for illustration in FIG. 2, fragmentation panels 28 are shown and would be spaced circumferentially around the longitudinal axis and affixed to end member 12 and bulkhead 24. Fragmentation panels 28 are thus sandwiched between inner shell 18 and outer shell 20. These panels may be interchanged with other fragmentation mechanisms, including discrete fragments and scored sheets.

Figure 3:
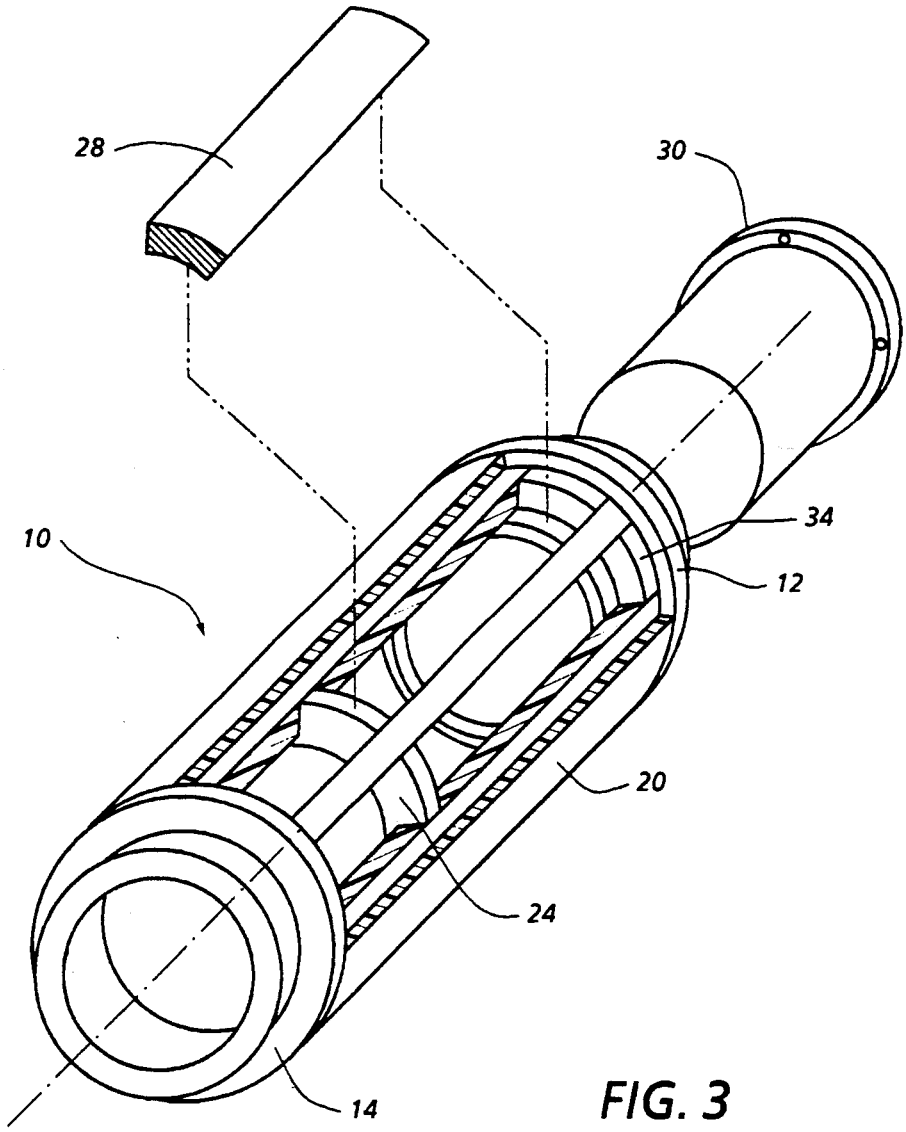
FIG. 3 is an isometric view of one embodiment of the ordnance section of FIG. 1 having a removable explosive cartridge.

FIG. 3 illustrates another embodiment wherein a high explosive cartridge 30 is used to replace the poured or pressed HE 22 in FIG. 2. In this embodiment, the inner shell 18 is eliminated and outer shell 20 then carries all shear loads. Forward annular member 12 would be a ring operatively sized to receive cartridge 30 and would provide connection and mounting hardware (not shown) for cartridge 30.

Figure 4:
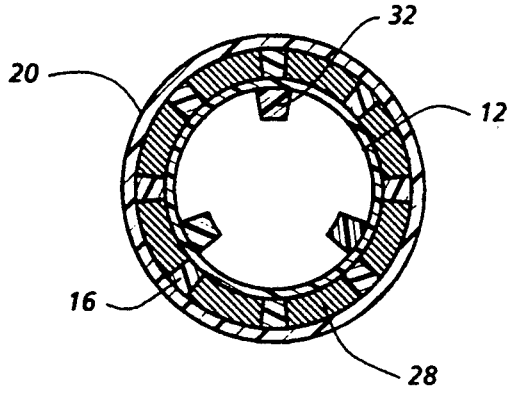
FIG. 4 is a detailed illustration of one of the end caps of the ordnance section of FIG. 3.

An example of a warhead using an explosive cartridge is taught in U.S. Pat. No. 4,781,117 to Garnett et al. issued Nov. 1, 1988, and is hereby incorporated by reference. FIG. 4 illustrates an annular ring 12 that is ring shaped to receive a HE cartridge 30. Therein forward annular member 12 has mounting flanges 32 to affix the cartridge 30 (not shown). Stringers 16 are shown supported by ring 12 and covered by outer shell 20, as are fragmentation panels 28. It is important to note that ring 12 will have a shoulder 34 as shown in FIG. 3.

Figure 5:
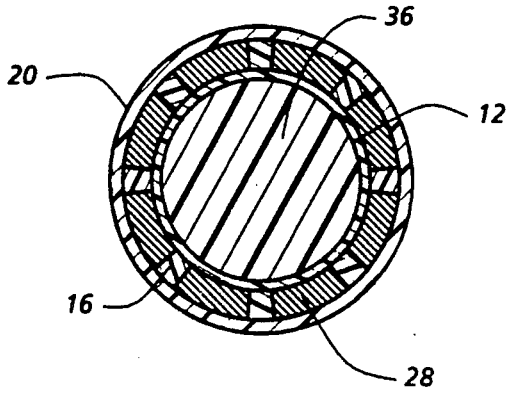
FIG. 5 is an alternate end cap for the ordnance section of FIG. 2 containing an integral explosive.

FIG. 5 illustrates the forward annular ring of the embodiment of FIG. 2. In this embodiment, ring 12 is actually a bulkhead which is formed by adding end cap 36 to close the forward end of the ordnance section. In this version, support ring 24 shown in FIG. 2 will also be a bulkhead, thus enclosing a cavity wherein HE 22 may be pressed or poured. It is considered to be a design choice whether to form the enclosure bulkheads by the addition of end caps 36 or to simply form support rings 12 and 24 as planar bulkheads.

End caps 36 may be formed of any material. In the preferred embodiment the end caps would be also formed of composites allowing additional cook-off protection.

Obviously many modifications and variations of the present invention are possible in the light of the above teachings.

What we claim is:

1. An ordnance section for a missile comprising:

a forward annular support member;

an aft annular support member;

a plurality of load bearing structural stringers disposed parallel to a longitudinal axis of the ordnance section fixedly attached to said forward annular support member and said aft annular support member thereby forming an outside structural lattice;

an annular solid bulkhead disposed between said forward annular support member and said aft annular support member whereby the ordnance section is divided into an explosive section and an electronics section;

a composite outer shell of substantially uniform thickness covering the ordnance section and forming the outside airframe of the missile attached to said plurality of stringers and affixed to said forward annular support member and said aft annular support member;

an inner composite shell of substantially uniform thickness disposed within said structural lattice extending from said forward annular support member toward said annular solid bulkhead defining a substantially closed cylindrical cavity for explosives;

a plurality of discrete fragmentation sections disposed between said plurality of structural stringers sandwiched between said inner and said outer composite shells; and a quantity of high explosive within the cavity defined within said inner composite shell.

2. An ordnance section according to claim 1 wherein said inner composite shell and said quantity of explosive are formed as a removable explosive cartridge.

3. An ordnance section according to claim 1 wherein said forward annular support member, said aft annular support member and said inner and outer shells are made of filamentary composite graphite epoxy.

4. An ordnance section according to claim 1 further defined by a means for sealing said forward annular support member whereby the explosive section is substantially sealed.

* * * * *